US011156392B2

(12) United States Patent
Denison et al.

(10) Patent No.: US 11,156,392 B2
(45) Date of Patent: Oct. 26, 2021

(54) METHOD AND APPARATUS FOR STAGED STARTUP OF AIR-COOLED LOW CHARGED PACKAGED AMMONIA REFRIGERATION SYSTEM

(71) Applicant: Evapco, Inc., Taneytown, MD (US)

(72) Inventors: Jake William Denison, Germantown, MD (US); Donald Lee Hamilton, Westminster, MD (US); Samuel K Vineyard, II, Casey, IL (US)

(73) Assignee: Evapco, Inc., Taneytown, MD (US)

( * ) Notice: Subject to any disclaimer, the term of this patent is extended or adjusted under 35 U.S.C. 154(b) by 0 days.

(21) Appl. No.: 16/697,917

(22) Filed: Nov. 27, 2019

(65) Prior Publication Data

US 2020/0191453 A1 Jun. 18, 2020

Related U.S. Application Data

(60) Provisional application No. 62/772,334, filed on Nov. 28, 2018.

(51) Int. Cl.
*F25B 41/40* (2021.01)
*F25B 39/02* (2006.01)
(Continued)

(52) U.S. Cl.
CPC ..... *F25B 41/40* (2021.01); *F25B 39/02* (2013.01); *F25B 39/04* (2013.01); *F25B 41/20* (2021.01);
(Continued)

(58) Field of Classification Search
None
See application file for complete search history.

(56) References Cited

U.S. PATENT DOCUMENTS 7,337,625 B1 3/2008 Cowans
8,763,419 B2 7/2014 Suganama
(Continued)

OTHER PUBLICATIONS

Low Ammonia Charge Refrigeration Systems for Cold Storage, Terry Chapp (2014).*
(Continued)

*Primary Examiner* — Elizabeth J Martin
(74) *Attorney, Agent, or Firm* — Whiteford, Taylor & Preston, LLP; Peter J. Davis

(57) ABSTRACT

An apparatus for staged startup of air-cooled low charged packaged ammonia refrigeration system includes motorized valves on condenser coil inlets, a main compressor discharge motorized valve, a bypass pressure regulator valve in the main compressor piping, and check valves on the condenser outlets. The condenser inlet motorized valves provide precise control of gas feed to the condensers, so pressure can build without collapsing oil pressure. The condenser outlet contains check valves to prevent liquid backflow during coil isolation. The compressor discharge line contains a motorized valve for regulating discharge pressure at start-up. The motorized valve in the compressor discharge piping includes a bypass with a pressure regulator for precise regulation at minimum discharge pressure. Once discharge pressure rises above the setpoint, the condenser inlet solenoid coils open one at a time. The discharge pressure regulating motorized valve simultaneously regulates the discharge pressure until the condenser maintains discharge pressure.

1 Claim, 4 Drawing Sheets

(51) Int. Cl.

| | |
|---|---|
| ***F25B 43/02*** | (2006.01) |
| ***F25B 39/04*** | (2006.01) |
| ***F25B 41/20*** | (2021.01) |
| ***F25B 41/31*** | (2021.01) |

(52) U.S. Cl.
CPC ..... *F25B 41/31* (2021.01); *F25B 43/02* (2013.01); *F25B 2339/02* (2013.01); *F25B 2339/04* (2013.01); *F25B 2400/0401* (2013.01); *F25B 2400/13* (2013.01)

(56) References Cited

U.S. PATENT DOCUMENTS

| | | | | |
|---|---|---|---|---|
| 2009/0173486 | A1 | 7/2009 | Copeland et al. | |
| 2013/0340470 | A1 | 12/2013 | Piesker et al. | |
| 2018/0045444 | A1 | 2/2018 | Liebendorfer et al. | |
| 2018/0156492 | A1 | 6/2018 | Kopko et al. | |
| 2018/0163998 | A1* | 6/2018 | Liebendorfer ..... | F25B 49/005 |
| 2019/0368754 | A1 | 12/2019 | Blanton | |
| 2020/0025396 | A1 | 1/2020 | Leon | |

OTHER PUBLICATIONS

International Search Report issued in co-pending application No. PCT/US2019/063621 dated Mar. 18, 2020.

* cited by examiner

AIR COOLED CONDENSER (ACC)
WHS COOLING
COND BYPASS
OIL COOLER
LOW HEAD TIS
ECONOMIZER SUCTION (ES)
ECONOMIZER VESSEL (ECV)
SCREW COMPRESSOR PACKAGE (SCS)
OIL TEMP. VALVE
MACHINE ROOM
CHARGING VALVE
LIQUID RECIRCULATOR VESSEL (LRV)
REFRIGERANT PUMP
EVAPORATOR MODULE
EVAPORATOR 1 (EVAP)
EVAPORATOR 2 (EVAP)

METHOD AND APPARATUS FOR STAGED STARTUP OF AIR-COOLED LOW CHARGED PACKAGED AMMONIA REFRIGERATION SYSTEM

BACKGROUND OF THE INVENTION

Field of the Invention

The present invention relates to ammonia refrigeration systems.

Description of the Background

Air-cooled (non-evaporative), ammonia refrigeration systems struggle to start during low-ambient conditions. As the compressor discharges superheated vapor into the condenser, the cold condenser coils immediately condense any vapor, preventing the discharge pressure to increase. Screw compressors require a minimum pressure delta across the housing to maintain proper oil flow to the compressor's components. The air-cooled condenser surface area is too large, due the very low ambient conditions (very high temperature differences) to allow the delta pressure to build at start-up. Chlorofluorocarbon refrigerant (CFC, HFC, HCFC) systems have utilized isolating valves on the outlet of condenser coils, which force liquid to back up in the condenser, reducing the surface area of the coil that is capable of condensing vapor. However, this requires significant charge that must be stored elsewhere in the system during normal operation. This is not acceptable to achieving low-charge and critically charged ammonia refrigeration systems.

SUMMARY OF THE INVENTION

The present invention overcomes the problems of the prior art by allowing the condenser coils to isolate individually during the startup period, allowing individual sequencing of the coils until the condenser is warm enough to maintain discharge and oil pressure. This invention also eliminates the need for a stand-alone oil pump to maintain oil pressure during start-up.

Several components provide the control required to stably and reliably operate the system during start-up: Motorized valves can be installed on all or one of the condenser coil inlets, a main compressor discharge motorized valve is installed, a bypass pressure regulator valve in the main compressor piping is installed, check valves on the condenser outlets are installed and speed control of the condenser fans. The condenser inlet motorized valves provide precise control of gas feed or act as an on/off valve for the condensers allowing pressure to build without collapsing the oil pressure. The motorized valves provide precise control of the gas flow at a very low pressure drop or provide on/off control as needed. The air-cooled condensers may be any style: tube and fin or microchannel, etc. in horizontal or vertical tube arrangements. The condenser coil outlet contains vertically-oriented inline check valves to prevent liquid backflow when a coil is isolated. This allows each condenser coil to be isolated without trapping significant liquid refrigerant charge in a low-charge ammonia, refrigeration system. Trapping an appreciable amount of liquid in the condenser coils upsets startup of a packaged ammonia refrigeration system. The compressor discharge line contains a single motorized valve for regulating discharge pressure. The motorized valve is used for coarse gas control at start-up.

The motorized valve in the compressor discharge piping also includes a bypass with a mechanical pressure regulator to allow precise regulation at the minimum discharge pressure. Once discharge pressure rises above the minimum setpoint, the condenser inlet solenoid coils will open one at a time. The discharge pressure regulating motorized valve will simultaneously regulate the discharge pressure until the condenser coil has warmed up enough to maintain discharge pressure. Fan speed control is also utilized to maintain stable operation at start-up.

DETAILED DESCRIPTION

Figure 1:
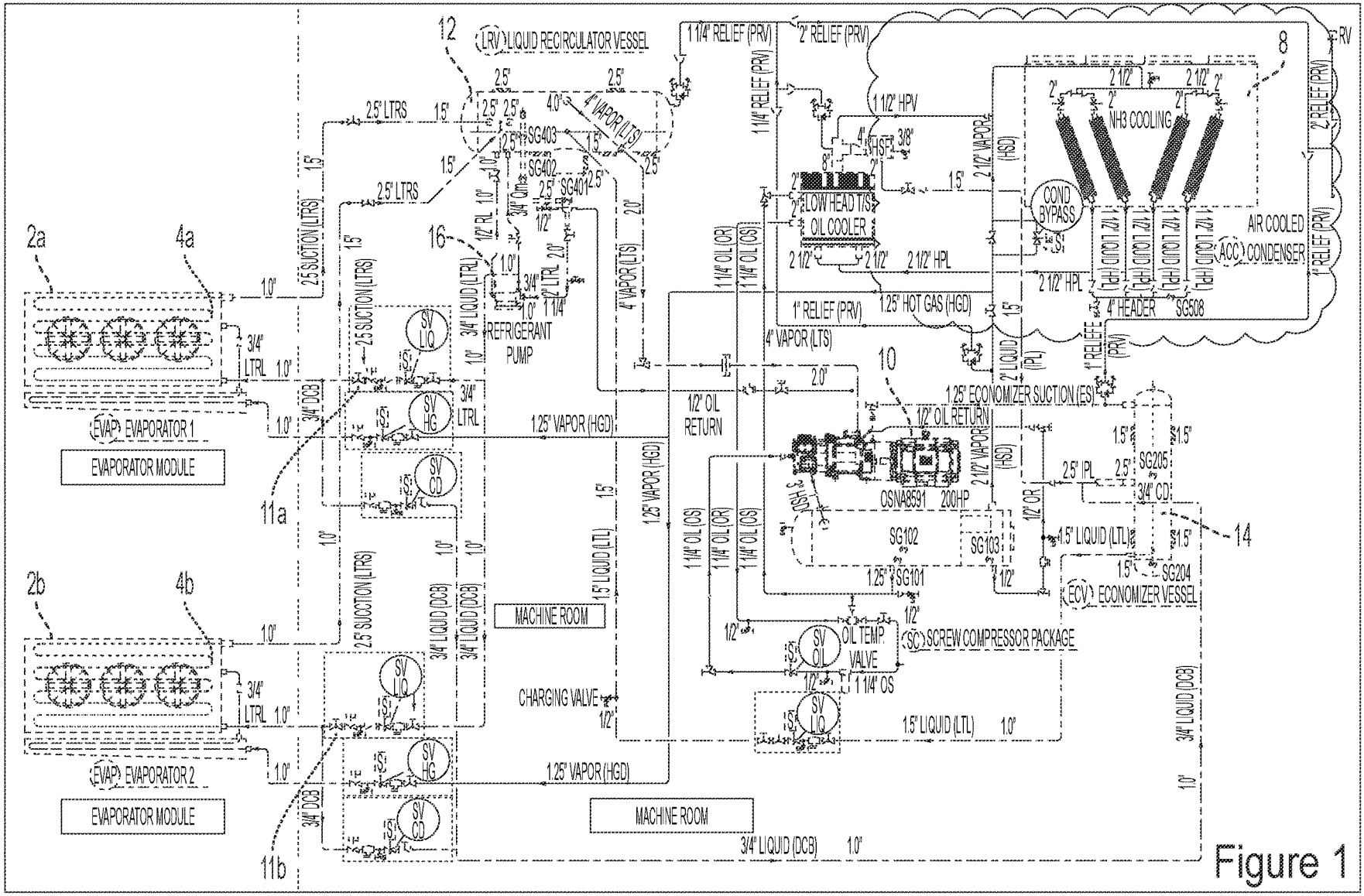
FIG. 1 is a schematic of a refrigeration system according to a single compressor embodiment of the invention.
Figure 2:
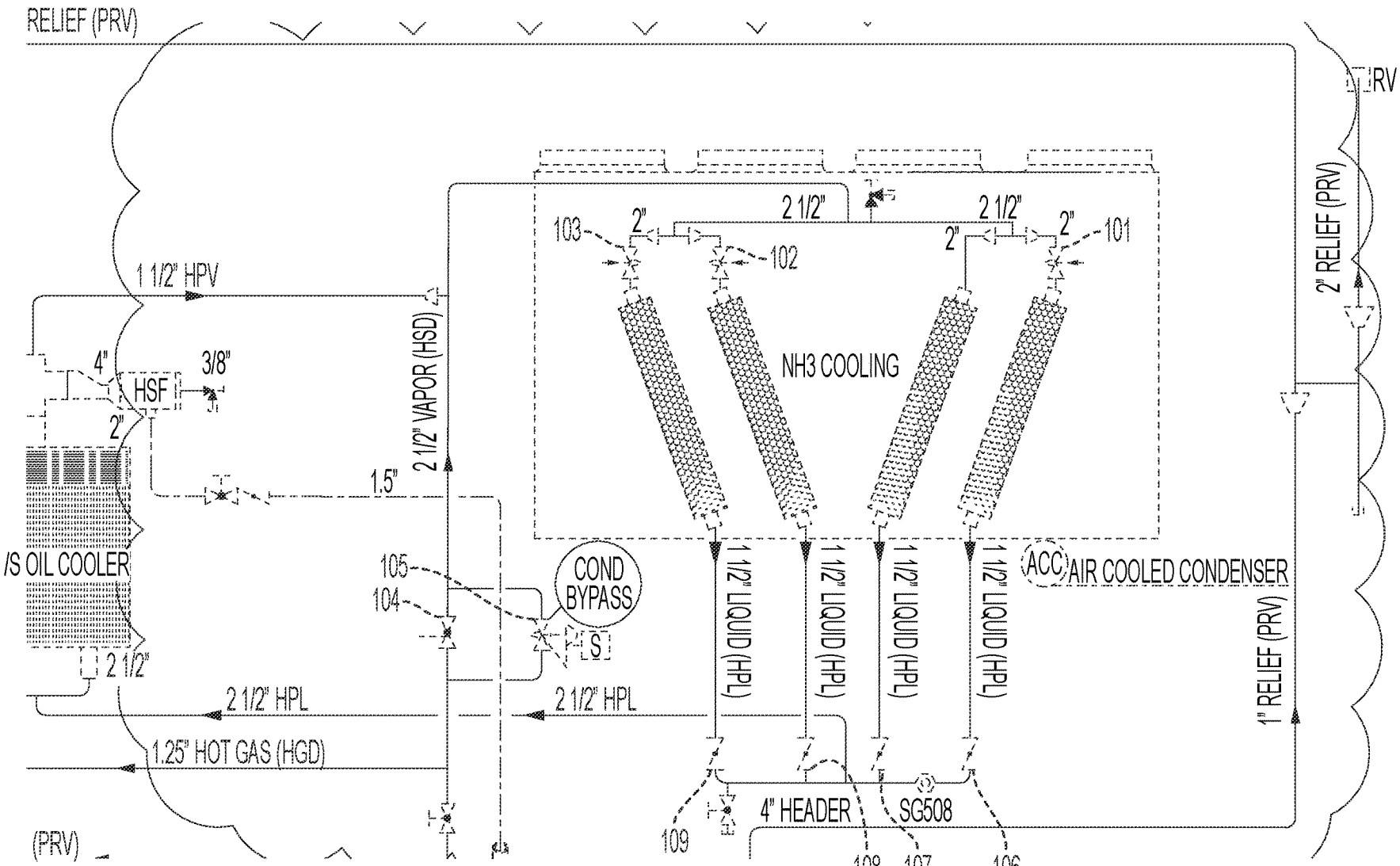
FIG. 2 is a blow-up of the upper right hand portion of FIG. 1.
Figure 3:
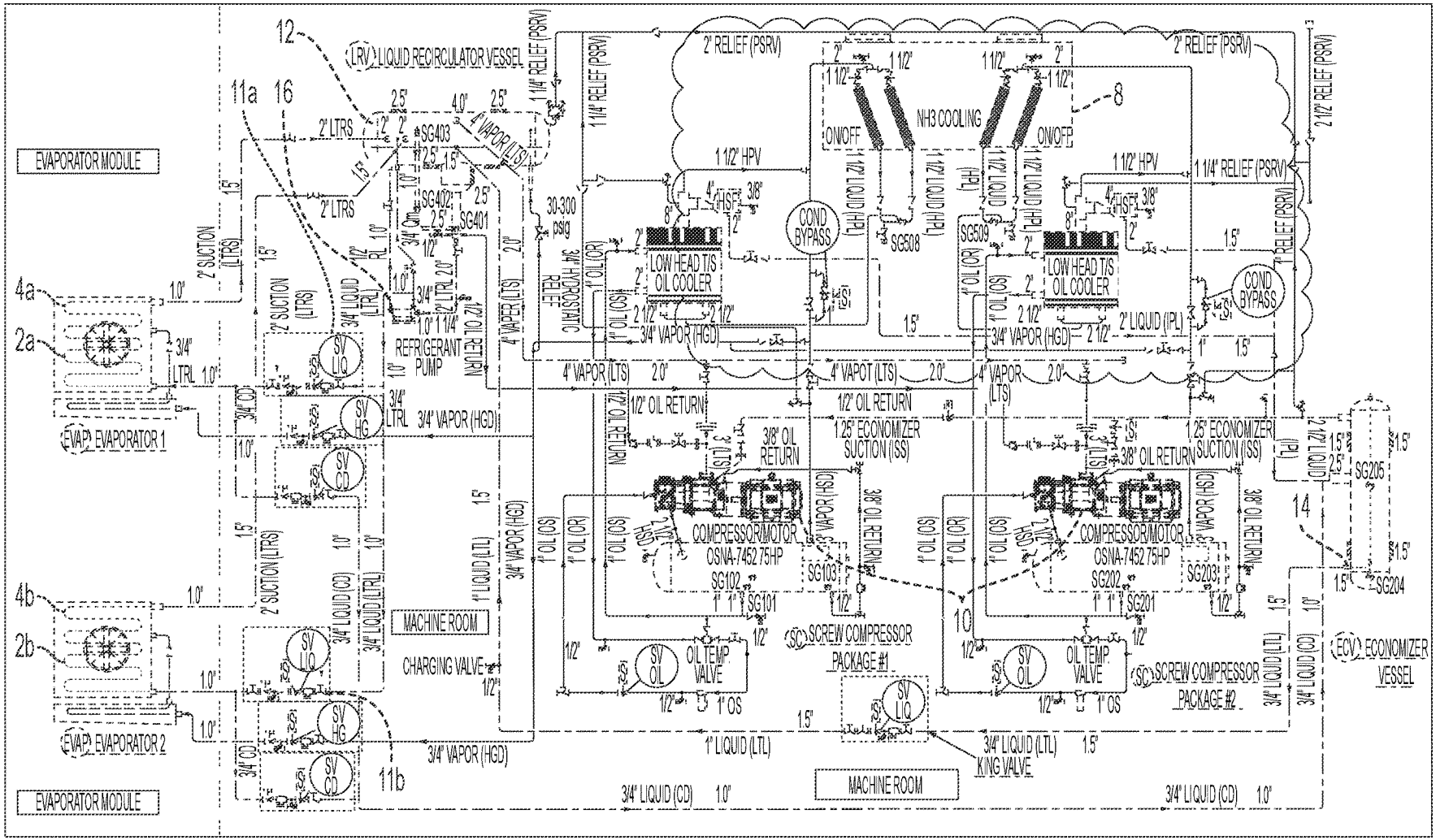
FIG. 3 is a schematic of a refrigeration system according to a dual compressor embodiment of the invention.

FIG. 1 is a process and instrumentation diagram for a single compressor, air-cooled (non-evaporative) condenser, low charge packaged penthouse refrigeration system according to an embodiment of the invention. A blow-up of the upper right quadrant of FIG. 1 is presented in FIG. 2. FIG. 3 is a process and instrumentation diagram for a dual compressor, air-cooled condenser, low charge packaged penthouse refrigeration system according to an embodiment of the invention. A blow-up of the upper right quadrant of FIG. 3 is presented in FIG. 4.

The system includes evaporators 2*a* and 2*b*, including evaporator coils 4*a* and 4*b*, respectively, condenser 8, compressor(s) 10, expansion devices 11*a* and 11*b* (which may be provided in the form of valves, metering orifices or other expansion devices), pump 16, liquid-vapor separation device 12, and economizer 14. According to one embodiment, liquid-vapor separation device 12 may be a recirculator vessel. According to other embodiments, liquid-vapor separation device 12 and economizer 14 may one or both provided in the form of single or dual phase cyclonic separators. The foregoing elements may be connected using standard refrigerant tubing in the manner shown in FIGS. 1-4. As used herein, the term "connected to" or "connected via" means connected directly or indirectly, unless otherwise stated.

According to the embodiment shown in FIGS. 1-4, low pressure liquid refrigerant ("LPL") is supplied to the evaporator by pump 16 via expansion devices 11. The refrigerant accepts heat from the refrigerated space, leaves the evaporator as low pressure vapor ("LPV") and liquid and is delivered to the liquid-vapor separation device 12 (which may optionally be a cyclonic separator) which separates the liquid from the vapor. Liquid refrigerant ("LPL") is returned to the pump 16, and the vapor ("LPV") is delivered to the compressor 10 which condenses the vapor and sends high pressure vapor ("HPV") to the condenser 8 which compresses it to high pressure liquid ("HPL"). The HPL is delivered to the economizer 14 which improves system efficiency by reducing the high pressure liquid ("HPL") to intermediate pressure liquid ("IPL") then delivers it to the liquid-vapor separation device 12, which supplies the pump 16 with low pressure liquid refrigerant ("LPL"), completing the refrigerant cycle.

FIGS. 1-4 also include numerous control, isolation, and safety valves, as well as temperature and pressure sensors (a.k.a. indicators or gages) for monitoring and control of the system.

Single Compressor Penthouse Improved Startup Configuration and Method

Referring to the single compressor embodiment (FIGS. 1 and 2, and particularly FIG. 2), motorized condenser inlet 101, 102 and 103 valves are installed on the inlet of the condenser coil bundles. The motorized valves can function as variable control valves or on/off valves.

A single condenser bundle is open to ensure proper surface is available during start-up. As the system begins increasing load, valves 101, 102 and 103 will begin to open. Once all valves are open, variable fan control takes over pressure control. The sequencing of the use of valves and fan operation can vary, based on system operation and design.

Motorized valve 104 and ammonia pressure regulator valve 105 provide precise ammonia gas control during start-up of the system in low ambient conditions. During start-up, all motorized valves are closed and the pressure regulator provides compressor differential pressure control to ensure proper oil flow. The ammonia pressure regulator 105 provides low volume flow control. As the compressor begins to load, more ammonia gas flow is generated. Motorized valve 104 begins to open and control the discharge pressure, compressor differential pressure and oil flow.

The next step during system start-up is to begin opening the condenser motorized valves 101, 102 and 103 and concomitant staging the startup of the condenser fans.

Check valves 106, 107, 108 and 109 installed at the outlet to the condenser bundles are utilized to ensure liquid ammonia does not backflow into the condenser or other coil bundles during periods of downtime or normal operating periods.

Each of valves 101, 102, 103 and 105 are activated by attached microcontrollers or PLC (programmable logic control). A central microcontroller or PLC monitors the status of each valve, as well as discharge pressure, and directs the action of the valves accordingly for sequential startup of the condenser coils while maintaining gas and oil pressure.

Not all valves are required for a every ambient condition. In fact, above a certain ambient temperature, low ambient control may not be required. Therefore, valves can be installed and arranged to optimize operation at startup based on the ambient temperature.

Dual Compressor Penthouse Improved Startup Configuration and Method (Isolated Compressor Operation)

Figure 4:
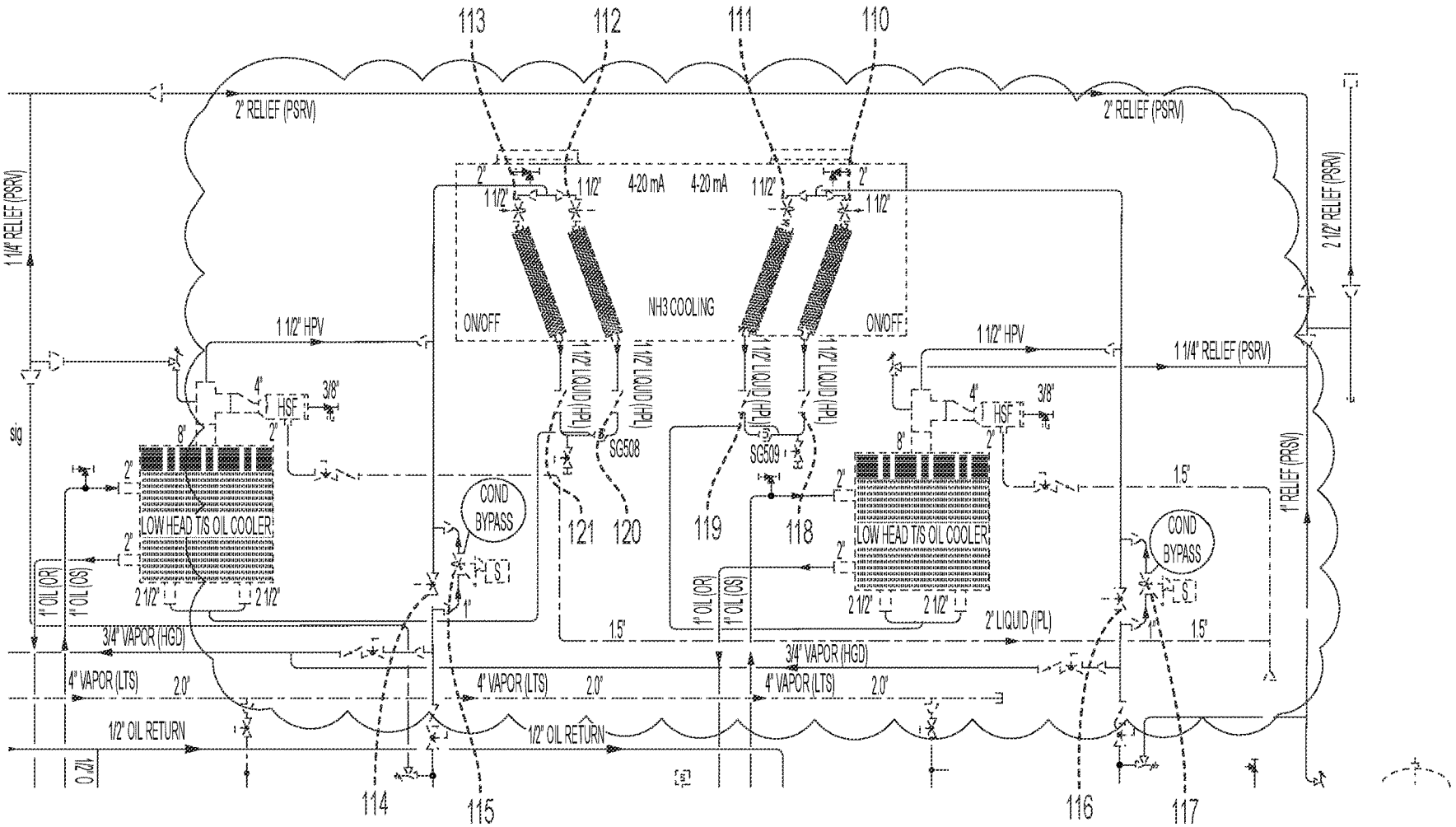
FIG. 4 is a blow-up of the upper right hand portion of FIG. 3.

FIGS. 3 and 4 show a process and instrumentation diagram for a dual compressor, air-cooled condenser, low charge packaged penthouse refrigeration system. The dual compressor design utilizes and isolated compressor concept. The compressors use different oil separators, oil coolers, and condenser bundles.

Motorized valves 110, 111, 112 and 113 are installed on the inlet of the condenser coil bundles. The motorized valves can function as variable control valves or on/off valves.

During startup, motorized valves 111 and 112 will be opened to a minimum position to allow ammonia gas flow to the condenser coil. As the system begins increasing load, valves 111 and 112 will open to 100% and valves 113 and 110 will begin opening. Once all valves are open, variable fan control takes over pressure control. The sequencing of the use of valves and fan operation can vary, based on system operation and design.

Fine ammonia gas control during start-up of the system is provided by:

Compressor #1 a. Valve #114 Motorized valve
b. Valve #115 Pressure regulator
c. Start-up requires all motorized valves are closed and the pressure regulator provides compressor differential pressure to ensure proper oil flow. During start-up, all motorized valves are closed and the pressure regulator provides compressor differential pressure control to ensure proper oil flow. The ammonia pressure regulator provides low volume flow control. As the compressor begins to load, more ammonia gas flow is generated. Motorized valve #114 begins to open and control the discharge pressure, compressor differential pressure and oil flow.

Compressor #2 a. Valve #116 Motorized valve
b. Valve #117 Pressure regulator
c. Start-up requires all motorized valves are closed and the pressure regulator provides compressor differential pressure to ensure proper oil flow. During start-up, all motorized valves are closed and the pressure regulator provides compressor differential pressure control to ensure proper oil flow. The ammonia pressure regulator provides low volume flow control. As the compressor begins to load, more ammonia gas flow is generated. Motorized valve #116 begins to open and control the discharge pressure, compressor differential pressure and oil flow.

The next stage is to begin opening the condenser motorized valves (110, 111, 112 and 113) and staging the condenser fans accordingly.

Check valves (118, 119, 120 and 121) are utilized to ensure liquid ammonia does not backflow into the condenser or other coil bundles during periods of downtime or normal operating periods.

As with the single compressor embodiment, each of valves 110-117 is activated by attached microcontrollers or PLC. A central microcontroller or PLC monitors the status of each valve, as well as discharge pressure, and directs the action of the valves accordingly for sequential startup of the condenser coils while maintaining gas and oil pressure. Not all valves are required for every ambient condition. In fact, above a certain ambient temperature, low ambient control may not be required. Therefore, valves can be installed and arranged to optimize operation at startup based on the ambient temperature.

According to various embodiments, the evaporator is housed in the evaporator (penthouse) module, and the remaining components of the system shown in FIGS. 1-4 (except for the condenser coils and fans and associated structures) are housed in an enclosure such as a machine room module. The condenser coils and fans may be mounted on top of the enclosure or machine room module for a complete self-contained rooftop system. The air-cooled condenser may optionally be fitted with an adiabatic air precooling system. The entire system may be completely self-contained in two roof-top modules making it very easy for over-the-road transport to the install site, using e.g., flat bed permit load non-escort vehicles. The penthouse and machine room modules can be separated for shipping and/or for final placement, but according to most preferred embodiments, the penthouse and machine room modules are mounted adjacent to one-another to maximize the reduction in refrigerant charge. According to a most preferred embodiment, the penthouse module and the machine room module are integrated into a single module, although the evaporator space is separated and insulated from the machine room space to comply with industry codes. According to an alternative embodiment, the evaporator coil may be mounted in a refrigerated space adjacent to, below, or remote from, the machine room module.

The combination of features as described herein provides a very low charge refrigeration system compared to the prior art. Specifically, the present invention is configured to require less than six pounds of ammonia per ton of refrigeration capacity. According to a preferred embodiment, the present invention can require less than four pounds of ammonia per ton of refrigeration. And according to most preferred embodiments, the present invention can operate efficiently with less than two pounds per ton of refrigeration capacity.

While the present invention has been described primarily in the context of refrigeration systems in which ammonia is the refrigerant, it is contemplated that this invention will have equal application for refrigeration systems using other natural refrigerants, including carbon dioxide.

The description of the invention is merely exemplary in nature and, thus, variations that do not depart from the concept of a packaged (one-or two-module integrated and compact system) low refrigerant charge (i.e., less than 10 lbs of refrigerant per ton of refrigeration capacity) refrigeration system are intended to be within the scope of the invention. Any variations from the specific embodiments described herein but which otherwise constitute a packaged, pumped liquid, recirculating refrigeration system with charges of 10 lbs or less of refrigerant per ton of refrigeration capacity should not be regarded as a departure from the spirit and scope of the invention set forth in the following claims.

The invention claimed is:

1. A method for start-up of an air-cooled ammonia refrigeration system having an evaporator, liquid/vapor separator, a compressor, an air-cooled condenser having a plurality of condenser coils, and a collection vessel without the need for a stand-alone oil pump to maintain oil pressure during start-up, said method comprising:

starting refrigerant flow through said condenser coils one at a time;

waiting to start refrigerant flow through each subsequent condenser coil until each prior started condenser coil is running at constant discharge and oil pressure;

using a motorized valve in a discharge line from said compressor for control of gas flow out of said compressor;

using a bypass pressure regulator valve in said discharge line from said compressor for additional control of gas flow out of said compressor;

using motorized valves at an inlet of at least one condenser coil in said air-cooled condenser to control gas feed to said condenser coil;

using check valves at an outlet of at least one condenser coil to prevent liquid backflow during coil isolation;

monitoring gas pressure in said discharge line from said compressor and controlling the opening of said motorized valves based on said monitored gas pressure using a microcontroller or programmable logic controller.

* * * * *